US005221249A

United States Patent [19]

Simpson

[11] Patent Number: 5,221,249

[45] Date of Patent: Jun. 22, 1993

[54] CREASING RULE FOR STEEL RULE CUTTING DIE

[75] Inventor: Jack R. Simpson, Raleigh, N.C.

[73] Assignee: Container Graphics Corporation, Cary, N.C.

[21] Appl. No.: 863,177

[22] Filed: Apr. 3, 1992

[51] Int. Cl.[5] ..... B31B 1/25; B31F 1/10; B31F 1/08

[52] U.S. Cl. ..... 493/354; 493/396; 76/107.8; 229/DIG. 4

[58] Field of Search ..... 493/59, 60, 61, 160, 493/161, 228, 240, 354, 395, 396, 397, 398, 399, 400, 401, 402, 403; 76/107.1, 107.8; 83/846, 847; 229/DIG. 4

[56] References Cited

U.S. PATENT DOCUMENTS

| | | | |
|---|---|---|---|
| 944,536 | 12/1909 | Bonfield et al. | 493/396 |
| 3,119,312 | 1/1964 | Henc | 493/471 |
| 3,152,492 | 10/1964 | Whitecotton | 76/107.8 |
| 3,321,874 | 5/1967 | Henc | 76/107.8 |
| 3,443,489 | 5/1969 | Watkins | 493/396 |
| 3,631,906 | 1/1972 | Forslund | 83/846 |
| 3,673,929 | 7/1972 | Saunders | 493/354 |
| 3,744,384 | 7/1973 | Jarritt et al. | 493/354 |
| 3,745,869 | 7/1973 | Ludwig | 83/846 |
| 3,916,749 | 11/1975 | Armelin | 493/60 |
| 4,482,417 | 11/1984 | Hulber et al. | 229/DIG. 4 |
| 4,589,863 | 5/1986 | Hodges | 493/471 |
| 4,967,477 | 11/1990 | Sanford | 83/847 |
| 5,064,409 | 11/1991 | Campbell et al. | 493/396 |

FOREIGN PATENT DOCUMENTS

| | | | |
|---|---|---|---|
| 157457 | of 1904 | Fed. Rep. of Germany | 493/471 |
| 2523647 | 4/1977 | Fed. Rep. of Germany | 493/403 |

*Primary Examiner*—William E. Terrell
*Attorney, Agent, or Firm*—Rhodes, Coats & Bennett

[57] ABSTRACT

A creasing rule is used in connection with a steel rule cutting die to form creases or fold lines in a blank cut from a sheet material, such as corrugated paper board. The creasing rule includes a base portion which fits into the slot of a die board, and a top portion which extends outwardly from the surface of the die board. The top portion terminates in a creasing edge, which, in cooperation with an anvil roll, compresses the sheet material to form a crease or fold line in the sheet material. The creasing edge of the creasing rule is formed with a plurality of undulations giving the creasing edge a generally sinusoidal form. The undulations on the creasing rule taper inwardly towards the plane of the base portion as the undulations extend from the creasing edge towards the base portion and finally merge into the flat base portion. The size or magnitude of the undulations can be varied depending on the thickness of the sheet material being used. Additionally, the pitch of the undulations (i.e. the number of undulations per linear inch) can be varied as desired to produce fold lines requiring different amounts of force and fold relief to bend.

9 Claims, 6 Drawing Sheets

CREASING RULE FOR STEEL RULE CUTTING DIE

FIELD OF THE INVENTION

The present invention relates generally to rotary cutting dies for cutting and shaping sheet material, such as corrugated paper board, in the manufacture of cartons, boxes, and interpaking. The invention more specifically relates to an improved creasing rule for producing creases or fold lines in a blank during the cutting operation.

BACKGROUND OF THE INVENTION

Rotary cutting dies are widely used for manufacturing boxes, cartons and interpak die cuts. The rotary die includes counter-rotating die and anvil rolls mounted in parallel spaced relation to one another. Both the die and anvil rolls typically comprise a metal cylinder. A cutting die is mounted on the die roll and includes a series of cutting rules and creasing rules. The anvil roll is covered with urethane or other resilient material. When the sheet material is fed between the rolls, the cutting die in cooperation with the anvil roll, cuts out a blank from the sheet material and forms creases where the blank is to be folded.

The cutting die includes a die board having a plurality of slits into which a series of cutting rules and creasing rules are fitted. In fabricating the cutting die, a pattern is laid out on a die board which corresponds to the shape of the blank being formed. Saw cuts are made in the die board to form the slots for holding the cutting and creasing rules. The cutting and creasing rules are inserted into the slots thus formed and project outwardly from the surface of the die board to engage the corrugated paper board as it is fed between the rolls.

The cutting rule i made from a flat piece of steel and has a serrated edge for cutting the corrugated paper board. The cutting rule is usually for four-point thickness (a point is equal to 0.01384 inches or approximately 1/72 of an inch). The creasing rule is also made from a flat piece of steel but has a round edge, instead of a serrated edge, for compressing the board to form a crease or fold line. Further, the creasing rule may have a thickness of two points, three points, four points, six points, eight points or more depending on the gauge of the corrugated stock to be creased. Generally, the gauge of the stock to be creased will dictate the size of the creasing rule. As the gauge of the stock increases, a thicker creasing rule is needed to satisfy the fold relief of the corrugated stock.

In the past, the thickness of the creasing rule was uniform throughout the cross section of the rule. Creasing rules of uniform thickness, however, were found to have significant drawbacks. For example, when placing a cutting rule of four point thickness end-to-end with a creasing rule of different thickness, there is some difficulty in lining the creasing rule with the cutting rule. To maintain the creasing rule and cutting rule in line, saw cuts of different widths must be made on the die board. To keep the rules in line, these saw cuts must be carefully placed, thus increasing the time and expense in the manufacture of the cutting die.

Creasing rules of uniform thickness also make it difficult to sue the same die on different thicknesses of stock. For example, if the size of the stock was changed so that a different size creasing rule was required, the slots formed in the die board would not accommodate the different thickness or width rule. Thus, a separate cutting die would have to be manufactured which was identical to the first die, but with slots formed to receive the larger creasing rules.

One solution to these problems is to vary the thickness of the creasing rule throughout its cross section such that the base portion (the portion which fits into the slots of the die plate) would be made the same thickness as the cutting rule. The top portion could be made of a larger thickness, such as four points or six points. Since the base portion is uniform on all of the creasing rules, different size creasing rules can be used interchangeably in the same cutting die. However, the creasing rules with non-uniform thickness are more costly to manufacture. Manufacture of these creasing rules is usually done by welding a thicker piece of metal stock to a conventional four point rule. This process is both expensive and time consuming.

Another undesirable result associated with the use of prior art creasing rules is that the creasing rules sometimes "crack" the surface layer of the corrugated paper board, particularly when the fold lines are made in a direction parallel to the flutes of the corrugated paper board. Once the surface layer of the corrugated paper board is "cracked", there is tendency for the crack to run the entire length of the board. The presence of "cracked" scores is undesirable and may render the boxes or cartons unusable.

SUMMARY AND OBJECTS OF THE INVENTION

The present invention is a creasing rule having a flat base portion and a tapered portion that terminates in an undulating creasing edge. The base portion will usually be of three or four points thickness while the effective width of the creasing edge (the peak-to-peak dimension of the undulations) will be a selected size greater than the thickness of the base portion. The size or magnitude of the undulations may be varied as desired depending on the gauge of the material being used. For example, when a heavy gauge board is being used, the size or magnitude of the undulations will usually be larger than when a lighter gauge paper board is used. The number of undulations per linear inch can also be varied to effect the amount of force required to fold the board. In applications where it is desirable to produce fold lines which fold in a particular sequence, the creasing rule of the present invention can be used advantageously by varying the pitch of the undulations. Creasing rules with different numbers of undulations can be used to form fold lines which fold in the desired sequence. In general, the greater the number of undulations in the creasing rule, the easier it will be to bend at the fold lines formed by such rule.

The creasing rule of the present invention also minimizes the number of "cracked scores." As previously mentioned, creasing rules used in the past have had a tendency to crack the surface layer of the corrugated paper board, particularly when the fold lines are made in a direction parallel to the flutes of the corrugated paper board. The creasing rule of the present invention is less likely than conventional creasing rules to crack the surface layer of the corrugated paper board. Further, even if the surface layer is cracked by the creasing rule of the present invention, there is less likelihood of the crack "running" the entire length of the board due to the undulations in the creasing rule changing direction abruptly.

Based on the foregoing, it is a principal object of the present invention to provide an improved creasing rule for a cutting die in which the effective width of the creasing edge of the rule can be varied without changing the dimensions of the base portion.

Another object of the present invention is to provide an improved creasing rule for a cutting die which will produce a crease or fold line in a corrugated paper board or similar sheet material without breaking the surface layer thereof.

Another object of the present invention is to provide a creasing rule for a cutting die which may be used to produce creases or fold lines which bend in a predetermined sequence in relation to other creases or fold lines.

Another object of the present invention is to provide a creasing rule of a cutting die which can be easily an economically manufactured.

Other objects and advantages of the present invention will become apparent and obvious from a study of the following description and the accompanying drawings which are merely illustrative of such invention.

BRIEF DESCRIPTION OF THE DRAWINGS

FIG. is a simplified perspective view of a die cutter with a cutting die.

DETAILED DESCRIPTION OF THE INVENTION

Figure 1:
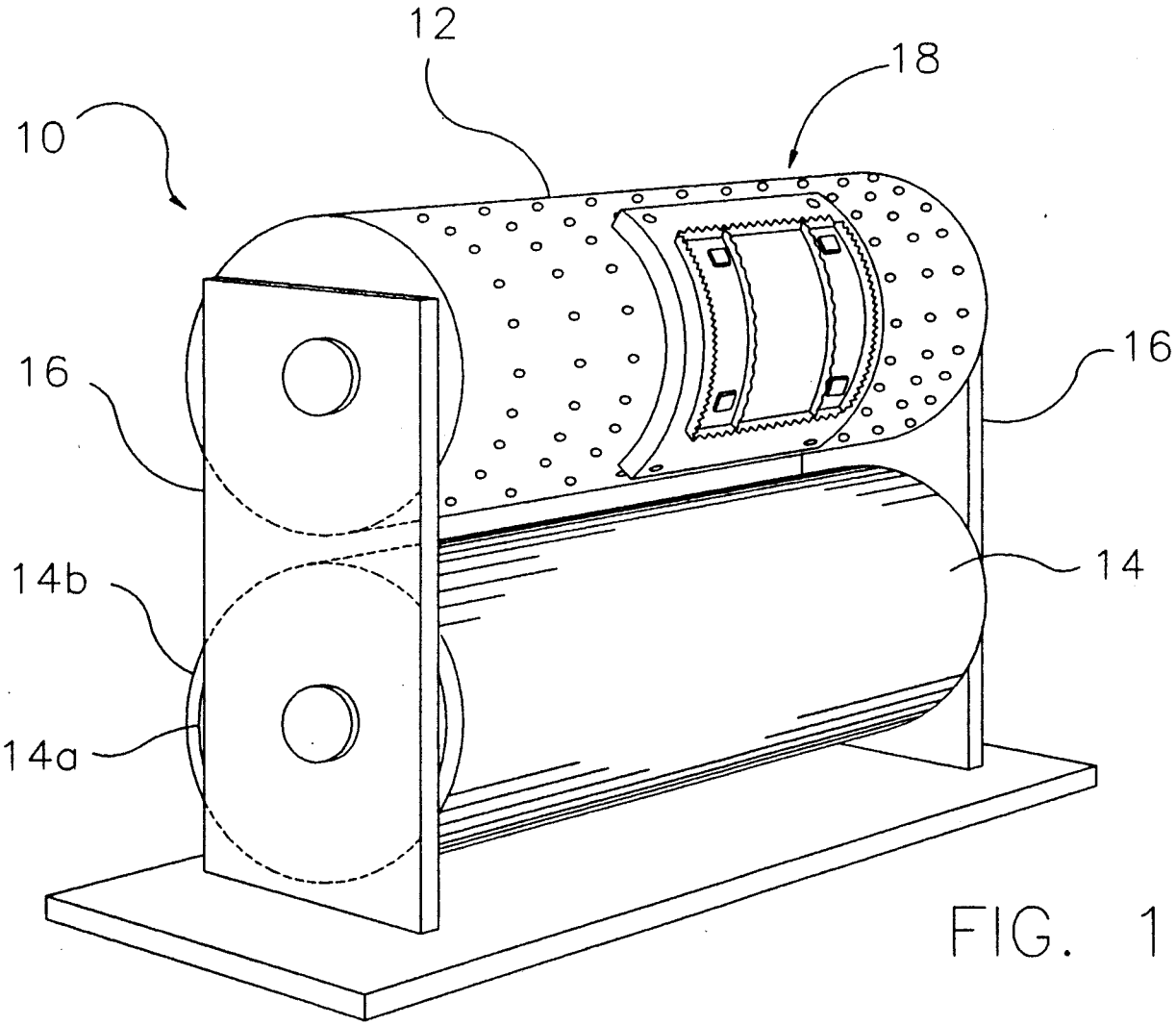

Referring now to FIG. 1, a rotary die cutter is shown therein and indicated generally by the numeral 10. The rotary die cutter 10 includes an upper die roll 12 and a lower anvil roll 14 which are rotatably mounted in a frame 16 in parallel spaced relation. The die roll 12 and anvil roll 14 are typically driven by suitable drive means (not shown) in opposite directions and a sheet material is fed between the rolls 12 and 14. The anvil roll is of conventional construction consisting of a metal cylinder 14*a* and having a resilient layer 14*b* made of urethane or other suitable material. The die roll 14 also includes a metal cylinder which has a plurality of threaded bores arranged in parallel rows. A cutting die, indicated generally at 18, is fixed to the core of the die roll 14 by threaded fasteners that screw into the threaded bores of the cylinder 12. Corrugated paper board or other sheet material is fed between the rolls 12 and 14. The cutting die 18, in cooperation with the anvil roll 14, cuts out a blank from the sheet material and forms creases or fold lines in the blank.

Figure 2:
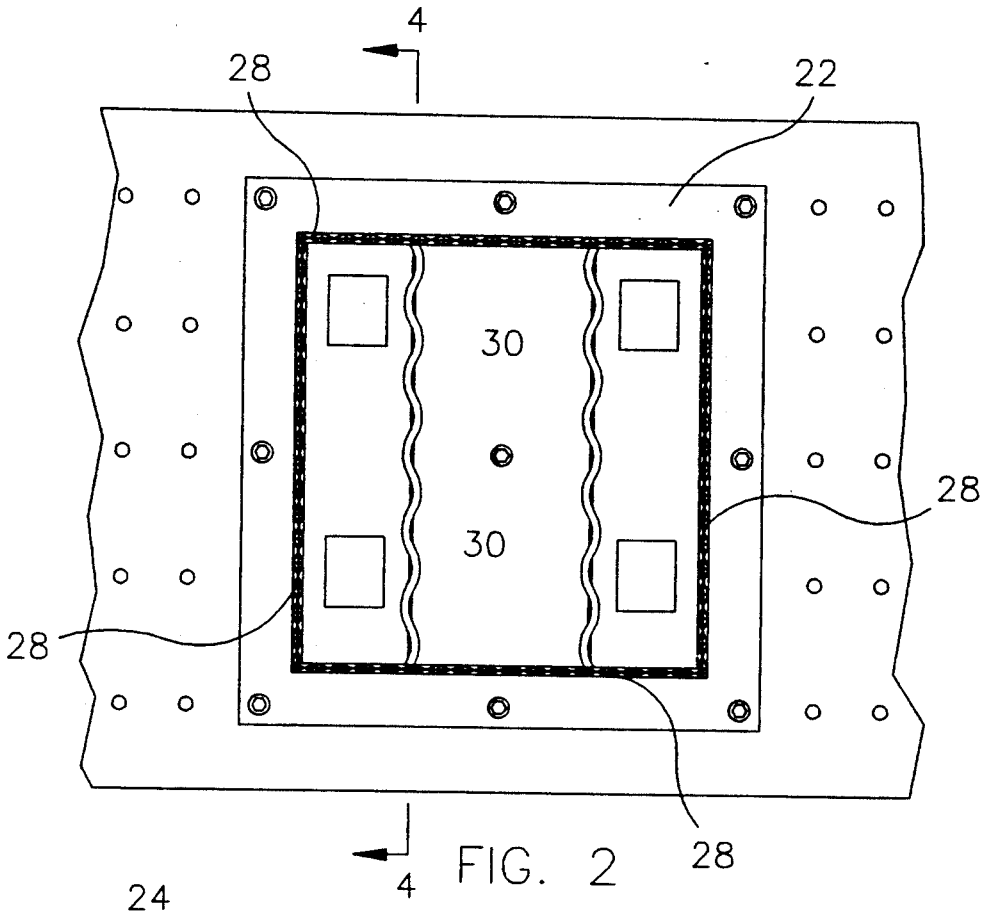
FIG. 2 is a schematic plan view of the cutting die mounted on the die cutter.
Figure 3:
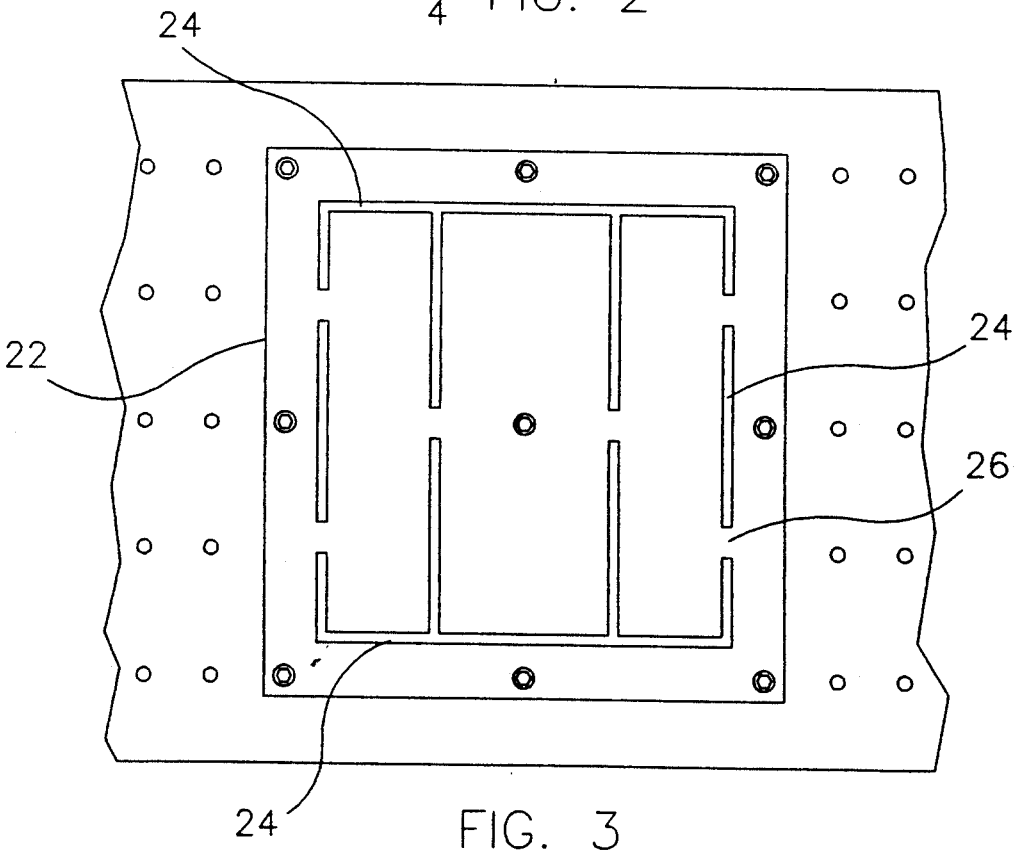
FIG. 3 is a schematic plan view of a die board for holding the cutting rules and creasing rules.

Referring now to FIGS. 2 and 3, there is shown a schematic plan view of a cutting die 18. The cutting die 18 includes a die board 22 which is usually made of a high quality plywood, such as a maple plywood. The die board is typically ½ inch in thickness but may sometimes be ⅝ inch in thickness. The die board 22 is formed in an arcuate shape to match the radius of the die roll 12. The die board 22 has a series of slots 24 formed therein for receiving a series of cutting rules 28 and creasing rules 30. To form the slots 24, the pattern of the blank is laid out on the die board 22 and saw cuts are made at appropriate locations where the cutting and creasing rules 28 and 30 are placed. The slots 24 are usually of three point or four point thickness and provide a tight friction fit with the cutting and creasing rules 28 and 30. The slots 24 are interrupted by bridges 26 which are small non-sawed sections spaced at predetermined intervals to maintain the structural integrity of the wooden die board 22. The cutting rules 28 and creasing rules 30 are fitted into appropriate slots 24 in the die board 22, by pounding the rules into the saw cuts with a mallet.

Referring now to FIGS. 5–8, the improved creasing rule 30 of the present invention is shown. The creasing rule 30 includes a base portion 32 terminating in a bottom edge 34, and a top portion 36 terminating in a creasing edge 38. A plurality of notches 40 are formed in the base portion 32 which permits the rule 30 to be bent into an arcuate form to match the radius of the die roll 12. The notches 40 define a plurality of tabs 42 which are separated by the notches 40. In a flat cutting die 18, the notches 40 are unnecessary and are usually omitted.

Figure 4:
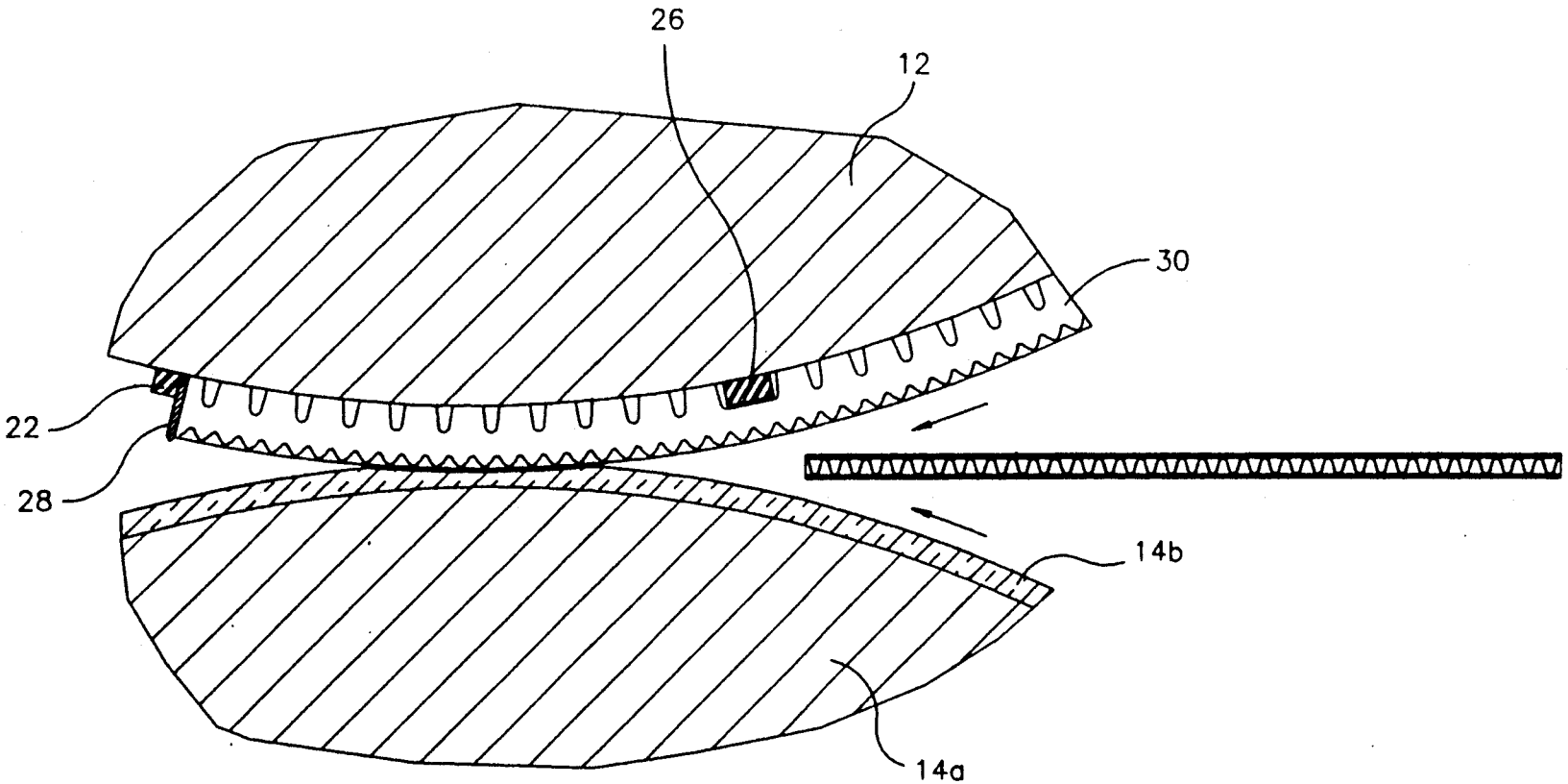
FIG. 4 is fragmentary sectional view of the rotary die showing the creasing rule of the present invention.

The base portion 32 of the creasing rule 30 is usually flat and has a thickness of three or four points. The base portion 32 fits snugly into the slots 24 in the die board 24 and is typically inserted into the slot by tapping the rule 30 lightly with a mallet. If the rule 30 crosses over one of the bridges 26 in the die board 22, on of the tabs 42 is removed to accommodate the bridge 26 as shown most clearly in FIG. 4.

The top portion 36 of the creasing rule 30 extends outwardly from the surface of the die board 22 approximately ¼ inch. The top portion 36 terminates in a creasing edge 38 which engages the sheet material to form the crease. The creasing edge 38 is smooth and rounded in cross-section to prevent the creasing rule 30 from cutting the corrugated paper board. In use, the creasing edge 38 is pressed into the corrugated paper board so as to compress the board and form a crease or fold line.

Figure 7:
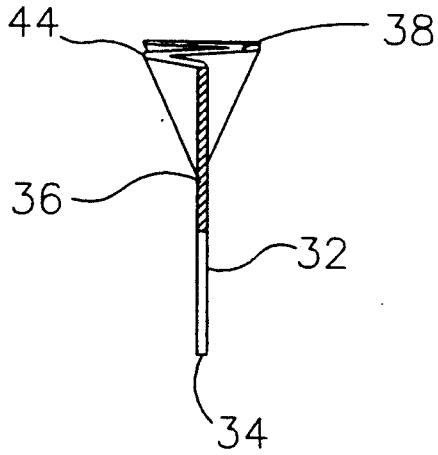
FIG. 7 is a cross-sectional view of the creasing rule.

Unlike conventional creasing rules, which form a straight crease or fold line, the creasing rule 30 of the present invention is specially designed to form an undulating or wavy fold line. To produce the undulating fold line, the top portion 36 of the rule 30 is shaped to form a plurality of undulations 44. When viewed from above, the creasing edge 38 has a sinusoidal form as can be clearly seen in FIG. 6. The undulations 44 taper upwardly and outwardly (as seen in FIG. 7) from the plane of the base portion 32 so that the magnitude of the undulations 44 is greatest along the creasing edge 38. Thus, when viewed in section, the creasing rule 30 of the present invention has a flat base portion (usually of three of four points in thickness) and a flared top portion 36 which terminates in an undulating top edge 38. The undulations 44 give the creasing rule 30 an effective width which is greater than the thickness of the base portion 32. The term "effective width" as used herein refers to the peak-to-peak measurement of the undulations 44.

Figure 5:
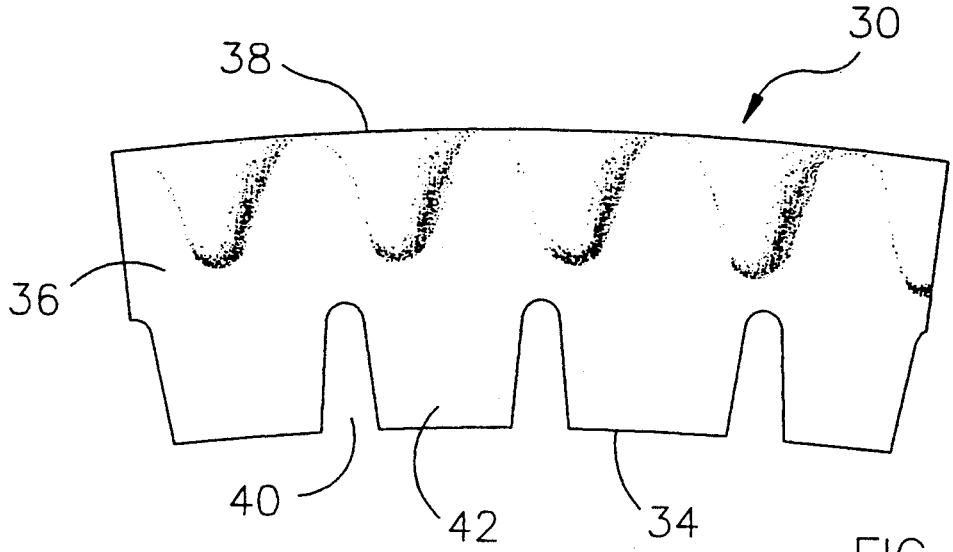
FIG. 5 is a fragmentary side elevational view of the creasing rule.
Figure 6:
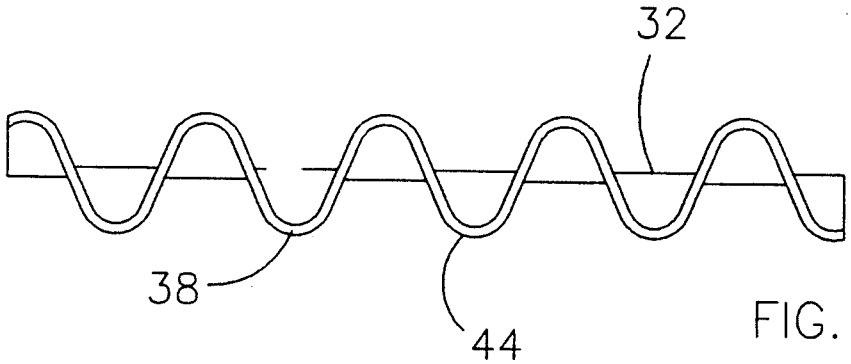
FIG. 6 is a fragmentary top plan view of the creasing rule.
Figure 9:
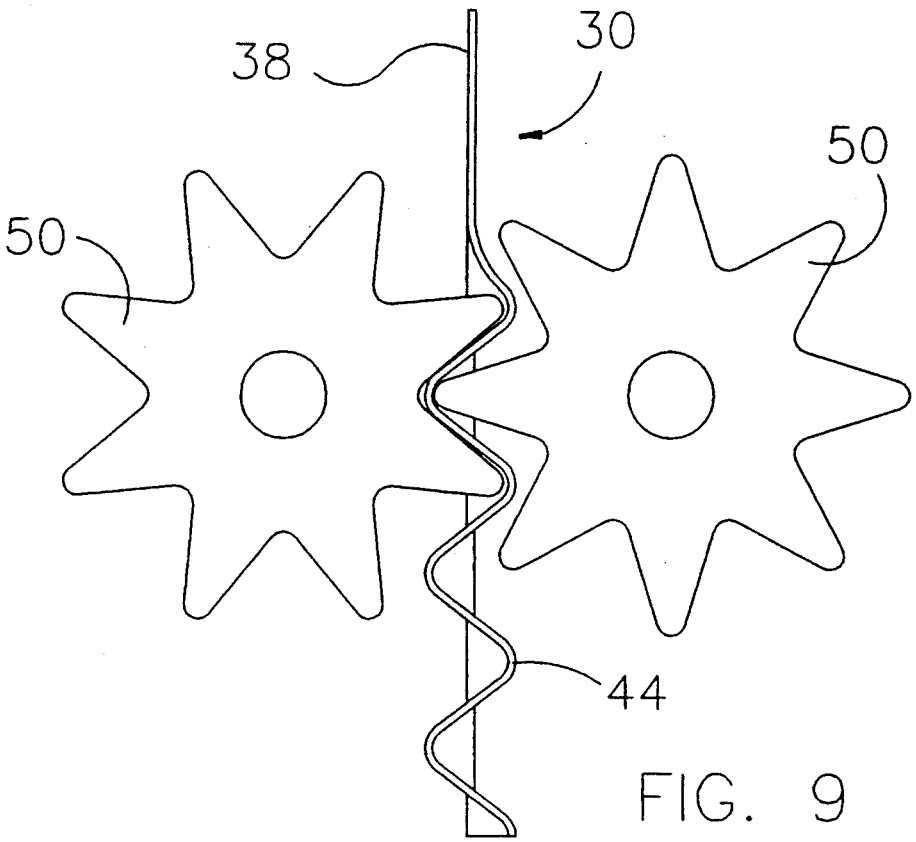
FIG. 9 is a schematic illustration showing how the undulations in the creasing rule are formed.
Figure 8:
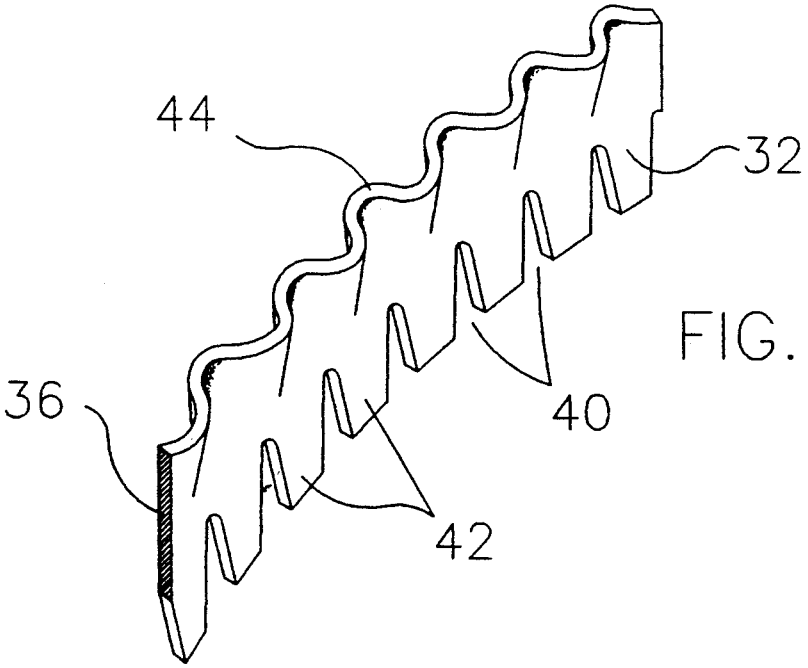
FIG. 8 is a perspective view of the creasing rule.

The creasing rule of the present invention is manufactured from a flat piece of stock. If the creasing rule 30 is to have an arcuate form, as shown in FIG. 5, the bottom edge of the stock is notched to permit the rule to be bent into the arcuate shape. To form the undulations 44, the top portion 36 of the creasing rule 30 is passed between a pair of gear-like forming tools, as shown in FIG. 9, to expand the edge of the rule outwardly to form the undulations 44. Thus, it will be readily apparent that the creasing rule of the present invention can be easily and economically manufactured.

Figures 10, 11, 12:
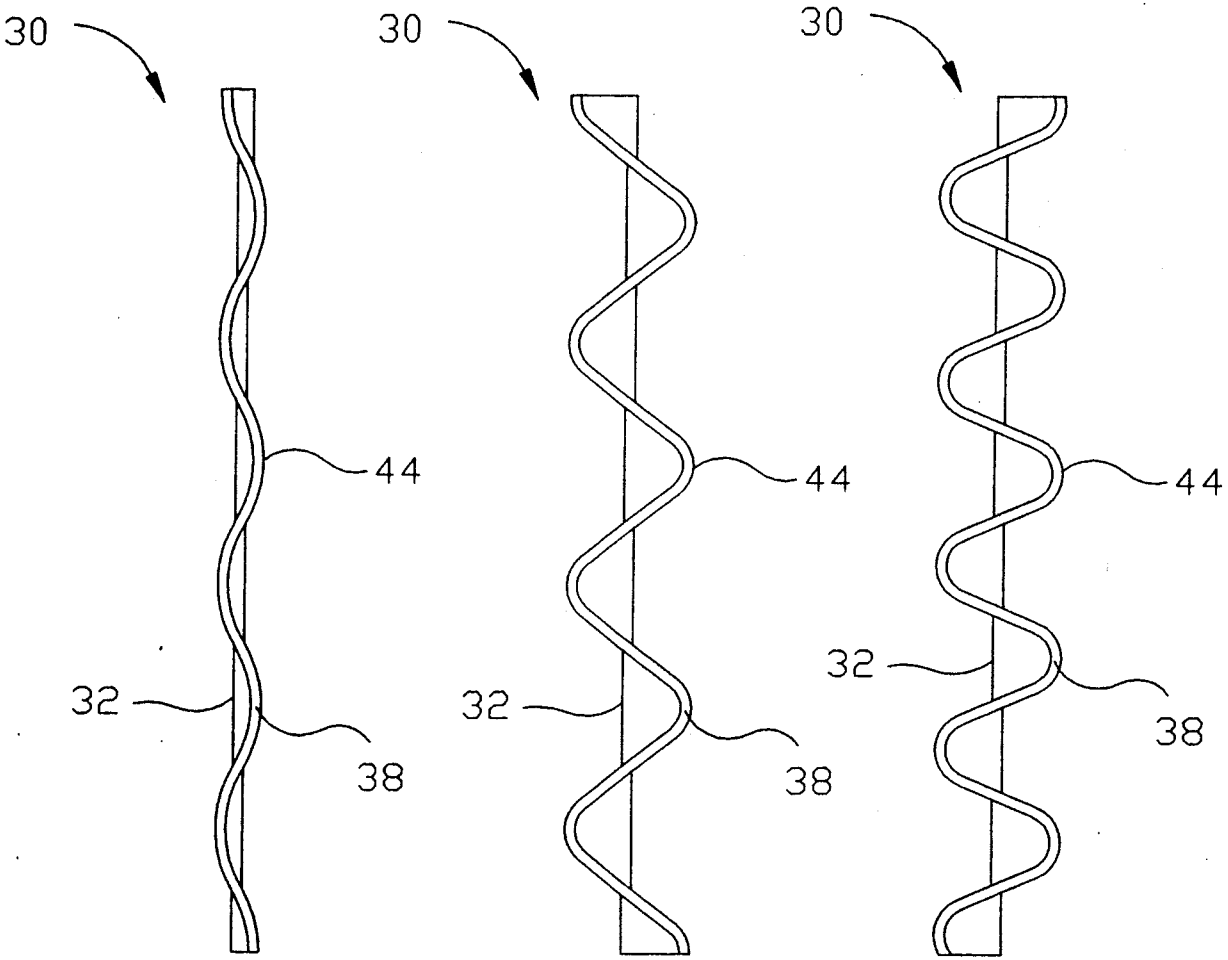
FIGS. 10–12 are fragmentary plan views of the creasing rule of the present invention showing variations in the size and number of undulations.

In use, the number of undulations 44 formed in the top edge 38 of the creasing rule 30 may be varied depending on the application. FIGS. 10–12 are top plan views are three different creasing rules 30 made in accordance with the present invention. FIGS. 10 and 11 show two creasing rules 30 having the same number of undulations 44 per linear inch. However, the magnitude of the undulations 44 of the rule 30 in FIG. 11 is greater than the magnitude of the undulations 44 of the rule 30 in FIG. 10. Generally speaking, the creasing rule 30 of FIG. 10 would be used with a lighter gauge of corrugated paper board than the creasing 30 rule of FIG. 11.

The creasing rules in FIGS. 11 and 12 have the same effective width or magnitude, but have different numbers of undulations 44. The creasing 30 shown in FIG. 12 has a greater number of undulations 44 per linear inch (referred to herein as pitch) than the creasing rule 30 of FIG. 11. Varying the pitch or number of undulations per inch can be used as a means to vary the force needed to fold or bend the board. That is, a creasing rule 30 with a large pitch will produce a fold line that bends easier than will a similar creasing rule 30 with a smaller pitch. This technique is particularly useful in such applications as wrap-around boxes, or when double-walled board vs. single-walled board is used.

Based on the foregoing, it is apparent that the creasing rules 30 of the present invention are freely interchangeable because the base portions can be made of a uniform thickness while the top portion 36 may be formed to achieve any desired effect. Further, the creasing rule of the present invention will more reliably form creases or fold lines in a blank, and is less likely to cut the surface layer of the corrugated paper board due to the undulations 44 in the creasing edge 38.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A cutting die for cutting a blank from a work material comprising:

(a) a die board;

(b) a plurality of slots formed in said die board;

(c) one or more cutting rules mounted on said die board for cutting a work material, each said cutting rule including a base portion for insertion into a respective slot in said die board, and a top portion extending outwardly from the top surface of the die board, said top portion terminating in a cutting edge for cutting the work material; and (d) one or more creasing rules mounted on said die board for producing fold lines in a work material, each said creasing rule including a planar base portion for insertion into a respective slot in said die board and a top portion extending outwardly from the top surface of the die board, said top portion terminating in a blunt creasing edge for compressing the work material to form a fold line therein, wherein said creasing edge has a plurality of undulations formed therein which taper upwardly and outwardly from said planar base portion so as to produce an undulating fold line in the work material.

2. The cutting die of claim 1 wherein the undulations are uniform throughout the length of the creasing rule.

3. The cutting die of claim 1 including a plurality of creasing rules, wherein at least two of the creasing rules have undulations of different magnitude.

4. The cutting die of claim 1 including a plurality of creasing rules, wherein at least two of the creasing rules have undulations of different pitch.

5. A creasing rule for a cutting die comprising:

(a) a planar base portion for mounting the rule on a die board;

(b) a top portion extending outwardly from the surface of the die board and terminating in a blunt creasing edge for engaging a sheet material and forming a fold line there, said top portion having a plurality of undulations formed therein which taper upwardly and outwardly from said planar base portion.

6. The creasing rule of claim 5 wherein said creasing edge is generally round when viewed in cross-section.

7. The creasing rule of claim 5 wherein the undulations re uniform throughout the length of the creasing rule.

8. A creasing rule having a design that permits a creasing edge to be expanded to different widths while maintaining the width of a base portion or the creasing rule generally constant, the creasing rule comprising: a strip having a generally planar base portion of a selected width and a blunt upper creasing edge having a plurality of undulations tapering upwardly and outwardly from the plane of the base portion such that the creasing edge is expanded to present an effective width greater than the width of the base portion.

9. A method of forming a crease of fold line in a sheet material using a creasing rule having a generally planar base portion of a predetermined thickness and a blunt creasing edge, said method comprising the steps of:

(a) forming a plurality of undulations in said creasing edge which extend in generally sinusoidal fashion relative to the planar base portion said undulations tapering upwardly and outwardly from said planar base portion such that the effective width of the creasing edge is greater than the width of the planar base portion;

(b) engaging the creasing edge of the creasing rule with the sheet material and compressing the sheet material to produce the fold line having a width greater than the thickness of the base portion of the creasing rule.

* * * * *